United States Patent [19]

Marolewski et al.

[11] 3,956,154

[45] May 11, 1976

[54] HYDRAULIC FLUID SYSTEM

[75] Inventors: Theodore A. Marolewski, New City; Peter E. Timony, Valley Cottage, both of N.Y.

[73] Assignee: Stauffer Chemical Company, Westport, Conn.

[22] Filed: Feb. 11, 1974

[21] Appl. No.: 441,701

[52] U.S. Cl. ..... 252/78; 252/49.8; 252/56 R; 252/79 HF

[51] Int. Cl.[2] ..... C09K 3/00; C10M 3/40

[58] Field of Search ..... 252/78, 79, 49.8, 56

[56] References Cited

UNITED STATES PATENTS

| | | | |
|---|---|---|---|
| 2,542,785 | 2/1951 | Walker | 252/79 |
| 3,513,097 | 5/1970 | Langenfeld | 252/78 |
| 3,629,114 | 12/1971 | Fairing | 252/78 X |
| 3,637,507 | 1/1972 | Gentit | 252/78 |

*Primary Examiner*—Harris A. Pitlick
*Attorney, Agent, or Firm*—Charles B. Rodman

[57] ABSTRACT

An aircraft hydraulic fluid comprising (1) a base stock material, and (2) a low molecular weight polyester additive consisting of $C_2$–$C_{18}$ dicarboxylic acid and a $C_2$–$C_{18}$ diol. By incorporating about 1 to about 20 percent by weight of said additive in said hydraulic fluid, an essentially shear stable hydraulic fluid results.

20 Claims, 1 Drawing Figure

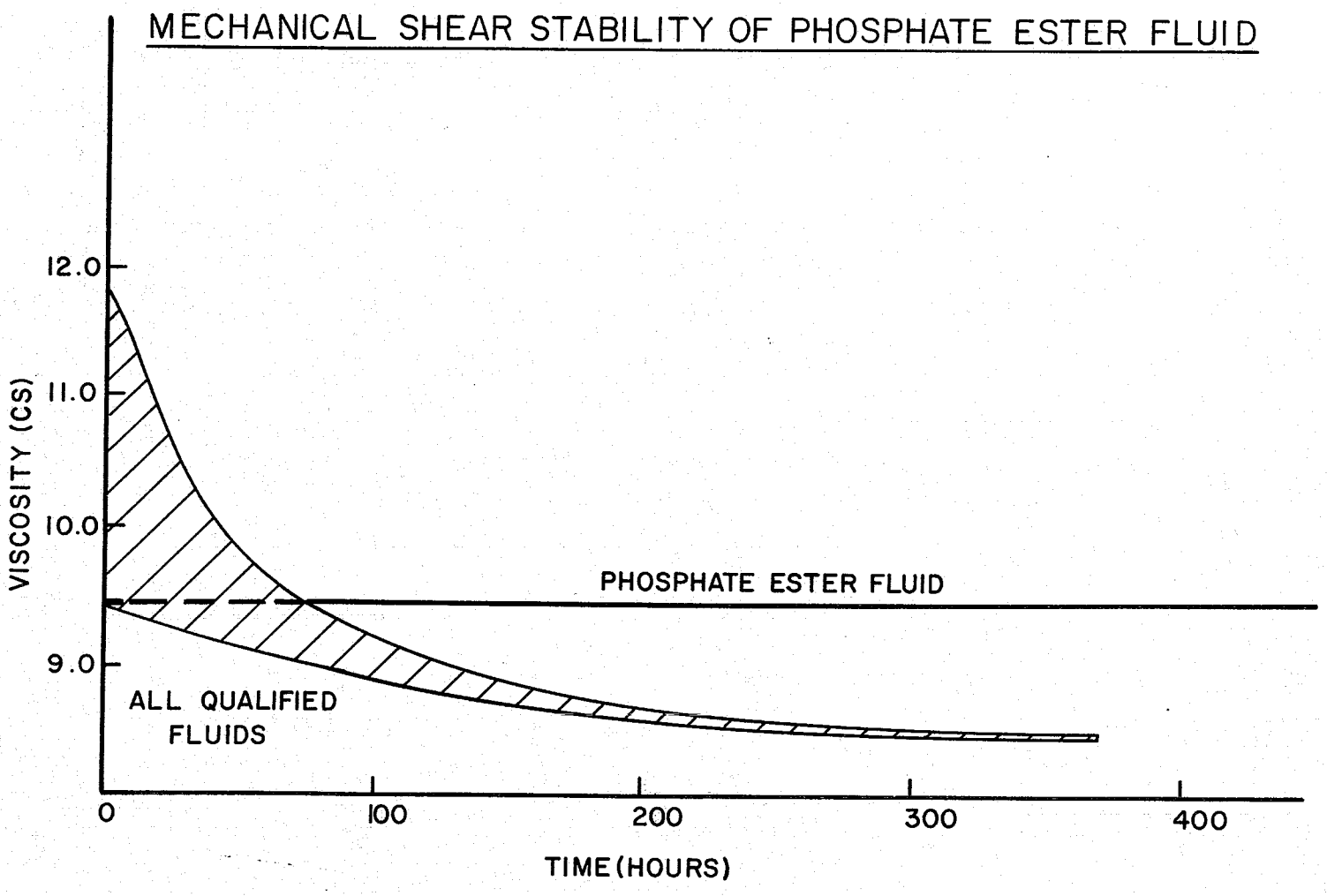
MECHANICAL SHEAR STABILITY OF PHOSPHATE ESTER FLUID
VISCOSITY (CS)
12.0
11.0
10.0
9.0
0
100
200
300
400
TIME (HOURS)
PHOSPHATE ESTER FLUID
ALL QUALIFIED FLUIDS

HYDRAULIC FLUID SYSTEM

BACKGROUND OF THE INVENTION

Many different types of materials are utilized as functional fluids and functional fluids are used in many different types of applications. Such fluids have been used as electronic coolants, atomic reactor coolants, diffusion pump fluids, synthetic lubricants, damping fluids, bases for greases, force transmission fluids (hydraulic fluids) and as filter mediums for air conditioning systems. Because of the wide variety of applications and the varied conditions under which functional fluids are utilized, the properties desired in good functional fluid necessarily vary with the particular application in which it is to be utilized with each individual application requiring a functional fluid having a specific class of properties.

At present, there are four major classes of hydraulic fluids used in industrial hydraulic systems. These are petroleum oils, water/glycol solutions, water-in-oil emulsions and completely synthetic types. It is well known in the art that the ability of the fluid to resist fluid propagation is one of degree. Fluids of the four types mentioned have varying degrees of fire-resistance and are used in applications according to the severity of the conditions, taking into account such factors as degree of danger from fire, operating temperature, bearing loads and cost.

The term "fire-resistant fluid" as used herein means a fluid of such chemical composition and physical characteristics that it will resist the propagation of flame under certain conditions hereinafter defined.

Many synthetic fluids such as the aryl phosphate esters offer a high degree of fire resistance and are usually employed when the danger from fire is great. The cost of synthetic fluids has restricted their use to the most severe conditions. The water containing fluids, while offering an acceptable degree of fire resistance at low cost, are not desirable in systems operating at high temperatures or where good lubricity of the fluid is required or where danger from fire is great.

Petroleum oils, while offering good lubricity, are the least fire resistant but are used in many applications having a marginal fire hazard due to their low cost and general availability. Previous attempts to render petroleum oil more fire resistant by incorporating therein known fire-resistant compounds such as phosphate esters have not produced fluids having a generally acceptable combination of lubricity, fire resistance and homogeneity.

Numerous proposals have been made for correcting one or another of these properties, but correction of one property is usually effected at the expense of another property. For example, the incorporation of alkyl phosphate esters in petroleum to improve fire resistance decreases hydrolytic stability. The aryl phosphate esters, while providing superior fire resistance and hydrolytic stability, can only be added in small amounts due to the limited miscibility of the esters in petroleum oils and such amounts are ineffective in producing any significant increase in fire resistance. Also, previously, aliphatic and olefinic chlorinated hydrocarbons have been combined with mineral oil to improve fire resistance; however, they have required either the use of only minor amounts of mineral oil thus not achieving economical fire-resistant compositions or the use of significant amounts of corrosion inhibitor because such chlorinated hydrocarbons tends to be corrosive to metals. The combination of approximately equal amounts of aryl phosphate esters and chlorinated hydrocarbons yields a fluid with good flame resistance and fair lubricity, but requires the addition of VI improvers to obtain a satisfactory viscosity index.

Of the foregoing, the use of functional fluids as lubricants and hydraulic fluids, particularly industrial lubricants and hydraulic fluids, has posed a difficult area of application. Increasing demands to improve the safety of industrial manufacturing as a whole has cause the extended use of fire-resistant fluids, e.g., fire-resistant lubricants and fire-resistant hydraulic fluids in a wide range of industries.

A number of fluids are known which are intended for use to transmit power in hydraulic systems including some fluids intended for use in the hydraulic systems of aircraft. However, the hydraulic power systems of aircraft for operating various mechanisms of an airplane impose stringent requirements on the hydraulic fluid used. Not only must the hydraulic fluid for aircraft meet stringent functional and use requirements, but in addition such fluid should be sufficiently non-flammable to satisfy aircraft requirements for fire resistance. The viscosity characteristics of this fluid must be such that it may be used over a wide temperature range; that is, adequate viscosity at high temperatures, low viscosity at low temperatures and a low rate of change of viscosity with temperature. Its pour point should be low. Its volatility should be low and the volatility should be balanced; that is, selective evaporation or volatilization of any important component should not take place at temperatures of use. It must possess sufficient lubricity and mechanical stability to enable it to be used in hydraulic systems of aircraft in which conditions are severe on the fluid used. It should be chemically stable to resist such chemical reactions as oxidation, thermal degradation, and the like so that it will remain stable under conditions of use and not lose the desired characteristics, due to high and sudden changes of pressure, temperature, and contact with various metals which may be, for example, aluminum, bronze, steels, and the like. It should also not deteriorate the gaskets and packing of the hydraulic system. It must not adversely affect the materials of which the system is constructed, and in the event of a leak, should not adversely affect the various parts of the airplane with which it may accidentally come in contact. It sould not be toxic or harmful to personnel who may come in contact with it. Furthermore, in addition to all such requisites for aircraft use, the fluids must be sufficiently non-flammable to meet aircraft requirements.

The importance of attaining a hydraulic fluid that is shear stable cannot be overemphasized.

All qualified fire resistant aircraft hydraulic fluids incorporate viscosity modifiers to maintain certain minimal viscosities at prescribed operating temperatures. Since these viscosity modifiers are generally high molecular weight polymers, they are prone to mechanical or sonic shear resulting in a viscosity decrease of the fluid. Since hydraulic equipment operates most efficiently at certain specified viscosities, an excessive viscosity change can lead to less efficient performance of the system.

BRIEF DESCRIPTION OF THE INVENTION

It has been discovered that improved shear stability is provided to a functional fluid material when a low molecular weight polyester additive of a $C_2$–$C_{18}$ dicarboxylic acid and a $C_2C_{18}C_{10}$ diol is added thereto.

DETAILED DESCRIPTION OF THE INVENTION

In the practice of the present invention, functional fluids, to which a low molecular weight polyester of a $C_2$–$C_{18}$ dicarboxylic acid and a $C_2$–$C_{18}$ diol of the present invention can be added, are referred to as base stocks. They include, but are not limited to, esters and amides of an acid of phosphorus, mineral oil and synthetic hydrocarbon oil base stocks, hydrocarbyl silicates, silicones, aromatic ether and thioether compounds, chlorinated biphenyl, monoesters, esters of dicarboxylic acids and monohydric alcohols, esters of monocarboxylic acids and polyhydric alcohols.

The concentration of low molecular weight polyester in the functional fluid is adjusted to give the desired viscosity. Fluids prepared in this manner are found to be completely shear stable.

Thus, it has been found that the concentration of low molecular weight polyester sufficient to give the desired viscosity varies according to the base stock or blends of base stocks and the particular polyester employed. It has generally been found that the additive level of low molecular weight polyester can vary from about 1 weight percent to about 20 weight percent, although about 3 to about 15 weight percent is preferred, and about 5 to 10 weight percent additive concentration is particularly preferred.

Thus, included in the present invention are compositions comprising a functional fluid and a low molecular weight polyester additive, in a concentration sufficient to give the desired viscosity. The functional fluid composition of this invention can be compounded in any manner known to those skilled in the art for incorporation of an additive into a base stock, as for example, by adding the low molecular weight polyester additive to the base stock with stirring until a homogeneous fluid composition is obtained.

The low molecular weight polyester of a dicarboxylic acid and a diol can be exemplified by the following formula:

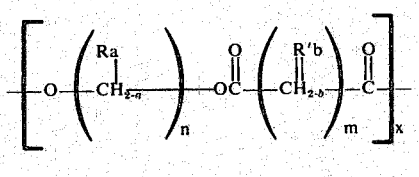

wherein R and R′ can be the same or different and represent alkyl, aryl and branched alkyl groups containing from 1 to 30 carbon atoms, $a$, $b$=0,1,2 and X=from about 2 to about 50 depending on the molecular weight, and $n$=2–18, and $m$=16.

By low molecular weight is meant from about 500 to about 10,000, most preferably about 2000 to about 5000.

Typical aliphatic dicarboxylic acids wherein R and R′ can be alkylene are oxalic acid, malonic acid, succinic acid, glutaric acid, adipic acid, pimelic acid, suberic acid, azelaic acid, sebacic acid, brassylic acid and thapsic acid, and wherein R and R′ can be alkenylene are maleic acid, fumaric acid, glutaconic acid, citraconic acid, itaconic acid, ethidenemalonic acid, mesaconic acid, allylmalonic acid, allylsuccinic acid, teraconic acid, xeronic acid and cetylmalonic acid.

Typical diols which can be used in the polyester formulation are: ethylene glycol, 1,2-or 1,3-propanediol, 1,2-, 1,3-, 1,4- or 2,3-butanediol, 1,3-, 1,4-, 1,1-, 2,3- or 2,4-pentanediol, 2-butene-1,2-diol, 2-butene-1,4-diol, 2-bromo-1,3-propanediol, 2-methyl-1,5-pentanediol, 2,4-dimethyl-2,4-pentanediol, 1,1,1-trifluoro-2,3-butanediol, 2,2-diethyl-1,4-butanediol, 2-pentene-1,5-diol, 2-propyl-1,3-butanediol, 2-chloro-1,5-pentanediol, 1,4-hexanediol, 5-methyl-1,2-hexanediol, 2-ethyl-1,3-hexanediol, 2-tert-butyl-3,3,4,4-tetramethyl-1,2-pentanediol, 4-methyl-1,4-hexanediol, 1,6-hexanediol, 3,3-dimethyl-1,6-hexanediol, 2,4-dimethyl-3-hexene-2,5-diol, 2,3-, 2,4-, 2,5- or 3,4-hexanediol, 1,2,3,6-hexanetetrol, 2-heptene-1,6-diol, 5-ethyl-3-methyl-2,4-heptanediol, 1,2-, 1,3-, 1,4-, 1-8-, 2,4-, 2,7- or 4,5-octanediol, 2-methyl-2-octene-1,4-diol, 2,4,4,5,5,7 -hexamethyl-3,6-octanediol, 2,7-dimethyl-4-octane-2,7-diol, 2-butyl-4-ethyl-3-methyl-1,3-octanediol, 1,9-nonanediol, 1,2- or 1,10-decanediol, 1,2- or 1,12-dodecanediol, 5-decyne-4,7-diol, 5,9-dimethyl-8-decene-1,5-diol, 5,8-diethyl-6,7-dodecanediol, 9-octadecene-1,12-diol, 9,10- or 1,12-octadecanediol,1,9- or 1,11-undecanediol, 1,13-tridecanediol, 1,2-tetradecanediol, 1,2- or 1,16-hexadecanediol, 16-methyl-1,2-heptadecanediol, 1,2- or 1,12-octadecanediol,2-methyl-1,2-propanediol,2-butyl-2-ethyl-1,3-propanediol,2,2-diethyl-1,3-propanediol, propanediol, 2-isobutyl-1,3-propanediol, 2-ethyl-1,3-propanediol, 2-ethyl-1,3-butanediol, 2,2-diethyl-1,4-butanediol, 2,2,3,3-tetramethyl-1,4-butanediol, o-m- or p-xylene-$\alpha,\alpha'$-diols, 3,6-dimethyl-o-xylene-$\alpha,\alpha'$-diol,$\alpha,\alpha'$-dimethyl-p-xylene-$\alpha,\alpha'$diol, 1,6-diphenyl-1,6-hexanediol, 1,2-diphenyl-1,2-ethanediol, 1- or 2-phenyl-1,2-propanediol, 2-methyl-1,2-propanediol, 2-di-o-tolymethyl-1,3-propanediol.

The above described low molecular weight polyesters are well known chemical entities in the art, and readily available. A particularly suitable low molecular weight polymeric formulation of azelaic acid and a diol is Plastolein[R] 9789, sold by Emery Industries.

The functional fluid compositions that are suitable for use as base stock materials with the present invention can be esters and amides of an acid of phosphorus which can be represented by the structure:

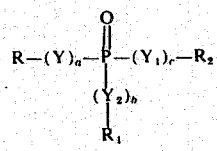

wherein Y is selected from the group consisting of oxygen, sulfur and

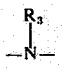

$Y_1$ is selected from the group consisting of oxygen, sulfur and

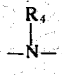

and $Y_2$ is selected from the group consisting of oxygen, sulfur and

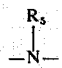

R, $R_1$, $R_2$, $R_3$, $R_4$ and $R_5$ are each selected from the group consisting of alkyl, aryl, substituted aryl and substituted alkyl containing 1–30 carbon atoms, wherein R, $R_1$, $R_2$, $R_3$, $R_4$ and $R_5$ each can be identical or different with respect to any other radical and *a*, *b* and *c* are whole numbers having a value of 0 to 1 and the sum of *a*+*b*+*c* is from 1 to 3.

Typical examples of alkyl radicals are as follows: methyl, ethyl, normal propyl, isopropyl, normal butyl, isobutyl, secondary butyl, tertiary butyl, normal amyl, isoamyl, 2-methylbutyl, 2,2-dimethyl propyl, 1-methyl butyl, diethylmethyl, 1,2-dimethyl propyl, tertiary amyl, normal hexyl, 1-methylamyl, 1-ethyl butyl, 1,2,2-trimethyl propyl, 3,3-dimethyl butyl, 1,1,2-trimethyl propyl, 2-methyl amyl, 1,1-dimethyl butyl, 1-ethyl 2-methyl propyl, 1,3-dimethyl butyl, isohexyl, 3-methylamyl, 1,2-dimethyl butyl, 1-methyl 1-ethyl propyl, 2-ethyl butyl, normal heptyl, 1,1,2,3-tetramethyl propyl, 1,2-dimethyl 1-ethyl propyl, 1,1,2-trimethyl butyl, 1-isopropyl 2-methyl propyl, 1-methyl 2-ethyl butyl, 1,1-diethyl propyl, 2-methyl hexyl, 1,1-dimethyl amyl, 1-isopropyl butyl, 1-ethyl 3-methyl butyl, 1,4-dimethyl amyl, isoheptyl, 1-methyl 1-ethyl butyl, 1-ethyl 2-methyl butyl, 1-methyl hexyl, 1-propyl butyl, normal octyl, 1-methyl heptyl, 1,1-diethyl 2-methyl propyl, 1,1,3,3-tetramethyl butyl, 1,1-diethyl butyl, 1,1-dimethyl hexyl, 1-methyl 1-ethyl amyl, 1-methyl 1-propyl butyl, 2-ethyl hexyl, 6-methyl heptyl (iso-octyl), normal nonyl, 1-methyl octyl, 1-ethyl heptyl, 1,1-dimethyl heptyl, 1-ethyl 1-propyl butyl, 1,1-diethyl 3-methyl butyl, diisobutyl methyl, 3,5,5-trimethyl hexyl, 3,5-dimethyl heptyl, normal decyl, 1-propyl heptyl, 1,1-diethyl hexyl, 1,1-dipropyl butyl, 2-isopropyl 5-methyl hexyl and $C_{11-18}$ alkyl groups.

Typical examples of substituted alkyl radicals are the haloalkyl radicals which can be represented by the structure

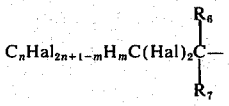

where Hal refers to a halogen, *m* is less than or equal to $2_{n+1}$ and *n* may have any value from 0 to 18, and $R_6$ and $R_7$ can be hydrogen, halogen or alkyl radicals. The halogenated alkyl radicals can be primary, secondary or tertiary.

Typical examples of aryl and substituted aryl radicals are phenyl, cresyl, xylyl, halogenated phenyl, cresyl and xylyl in which the available hydrogen on the aryl or substituted aryl is partially or totally replaced by a halogen, o-, m- and p-trifluoromethylphenyl, o-, m- or p-2,2,2-trifluoroethylphenyl, o-, m- and p-3,3,3-trifluoropropylphenyl and o-, m- and p-4,4,4-trifluorobutylphenyl.

The orthosilicates useful as base stocks include the tetraalkyl orthosilicates such as tetra(octyl)orthosilicates, tetra(2-ethylhexyl)orthosilicates and the tetra(isooctyl)orthosilicates and those in which the isooctyl radicals are obtained from isooctyl alcohol which is derived from the oxo process, and the (trialkoxysilico)-trialkyl orthosilicates, otherwise referred to as hexa(alkoxy) disiloxanes, such as hexa(2-ethylbutoxy) disiloxane and hexa(2-ethylhexoxy) disiloxane.

The orthosilicates and alkoxy polysiloxanes can be represented by the general structure

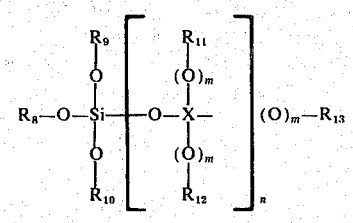

wherein $R_8$, $R_9$ and $R_{10}$ each can be alkyl, substituted alkyl, aryl, substituted aryl and can be identical or different with respect to any other radical, O is oxygen, Si is silicon, X is a member of the group consisting of carbon and silicon, *m* is a whole number having a value of 0 or 1, *n* is an integer having a value of from 1 to about 200 or more and when X is carbon *m* is 0, *n* is 1 and $R_{11}$, $R_{12}$ and $R_{13}$ each can be hydrogen, alkyl, substituted alkyl, aryl and substituted aryl radicals and when X is silicon *m* is 1, *n* is an integer having a value of from 1 to about 200 or more and $R_{11}$, $R_{12}$ and $R_{13}$ each can be alkyl, substituted alkyl, aryl and substituted aryl.

Typical examples of substituted aryl radicals are o-, m- and p-chlorophenyl, o-, m- and p-bromophenyl, o-, m- and p-fluorophenyl, α,α,α-trichlorocresyl, α,α,α-trifluorocresyl, xylyl and o-, m- and p-cresyl. Typical examples of alkyl and haloalkyl radicals are those heretofore described.

The siloxanes or silicones useful as base stocks are represented by the general structure

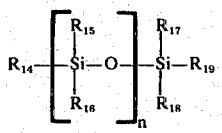

wherein $R_{14}$, $R_{15}$, $R_{16}$, $R_{17}$, $R_{18}$ and $R_{19}$ can each be alkyl, substituted alkyl, aryl and substituted aryl radicals and *n* is a whole number from about 0 to about 2000 or more. Typical examples of alkyl and haloalkyl radicals are those heretofore described. Typical examples of the siloxanes are poly(methyl) siloxane, poly(methyl, phenyl) siloxane, poly(methyl, chlorophenyl)-siloxane and poly(methyl, 3,3,3trifluoropropyl)siloxane.

Typical examples of substituted aryl radicals and o-, m- and p-chlorophenyl, o-, m- and p-bromophenyl, o-, m- and p-fluorophenyl, α,α,α-trichlorocresyl, α,α,α-trifluorocresyl, o-, m- and p-cresyl and xylyl.

Dicarboxylic acid esters which are suitable as base stocks are represented by the structure

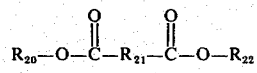

wherein $R_{20}$ and $R_{22}$ are each selected from the group consisting of alkyl, substituted alkyl, aryl and substituted aryl and $R_{21}$ is a divalent radical selected from the group consisting of alkylene and substituted alkylene, and are prepared by esterifying dicarboxylic acids as adipic acid, azelaic acid, suberic acid, sebacic acid, hydroxysuccinic acid, fumaric acid, maleic acid, etc., with alcohols such as butyl alcohol, hexyl alcohol, 2-ethylhexyl alcohol, dodecyl alcohol, 2,2-dimethyl heptanol, 1-methyl cyclohexyl methanol, etc.

Typical examples of alkyl, aryl substituted alkyl and substituted aryl radicals are given above.

Polyesters which are suitable as base stocks are represented by the structure

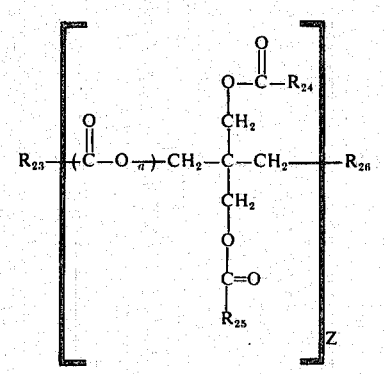

wherein $R_{23}$ is selected from the group consisting of hydrogen and alkyl, $R_{24}$ and $R_{25}$ are each selected from the group consisting of alkyl, substituted alkyl, aryl and substituted aryl, *a* is a whole number having a value of 0 to 1, Z is a whole number having a value of 1 to 2 and when Z is 1, $R_{26}$ is selected from the group consisting of hydrogen, alkyl acyloxy and substituted acyloxy and when Z is 2, $R_{26}$ is oxygen, and are prepared by esterifying such polyalcohols as pentaerythritol, dipentaerythritol, trimethylolpropane, trimetholoethane and neopentyl glycol with such acids as propionic, butyric, isobutyric, n-valeric, caproic, n-heptylic, caprylic, 2-ethylhexanoic, 2,2-dimethylheptanoic and pelargonic. Typical examples of alkyl, substituted alkyl, aryl and substituted aryl radicals are given above.

Other esters which are also suitable as base stocks are the mono esters.

Another class of base stocks which are suitable as base stocks for this invention are represented by the structure

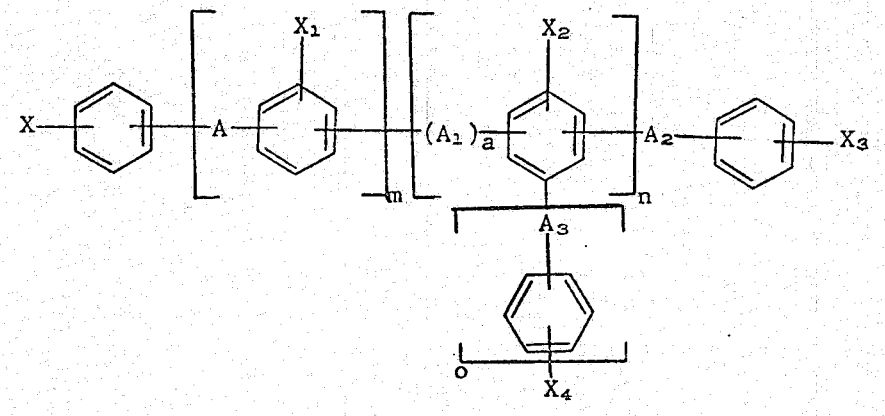

wherein A, $A_1$, $A_2$ and $A_3$ are each a chalcogen having an atomic number of 8 to 16, X, $X_1$, $X_2$, $X_3$ and $X_4$ each are selected from the group consisting of hydrogen, alkyl, haloalkyl, halogen, arylalkyl and substituted arylalkyl, *m*, *n* and *o* are whole numbers each having a value of 0 to 8 and *a* is a whole number having a value of 0 to 1 provided that when *a* is 0, *n* can have a value of 1 to 2. Typical examples of alkyl and substituted alkyl radicals are given above. Typical examples of each base stocks are 2- to 7-ring ortho-, meta- and para-polyphenyl ethers and mixtures thereof, 2- to 7-ring ortho-, meta- and para-polyphenyl thioethers and mixtures thereof, mixed polyphenyl ether-thioether compounds in which at least one of the chalcogens represented by A, $A_1$, $A_2$ and $A_3$ is dissimilar with respect to any one of the other chalcogens, dihalogenated diphenyl ethers, such as 4-bromo-3'-chlorodiphenyl ethers and bisphenoxy biphenyl compounds and mixtures thereof.

Hydrocarbon oils including mineral oils derived from petroleum sources and synthetic hydrocarbon oils are suitable base stocks. The physical characteristics of functional fluids derived from a mineral oil are selected on the basis of the requirements of the fluid systems and therefore this invention includes as base stocks mineral oils having a wide range of viscosities and volatilities such as naphthenic base, paraffinic base and mixed base mineral oils.

The synthetic hydrocarbon oils include but are not limited to those oils derived from oligomerization of olefins such as polybutenes and oils derived from high alpha olefins of from 8 to 20 carbon atoms by acid catalyzed dimerization and by oligomerization using trialuminum alkyls as catalysts.

Chlorinated biphenyls are also useful as base stocks.

It is also contemplated within the scope of this invention that mixtures of two or more of the aforedescribed base stocks can be utilized as base stocks.

The fluid compositions of this invention when utilized as a functional fluid can also contain dyes, pour point depressants, antioxidants, antifoam agents, viscosity index improvers such as polyalkyl acrylates, polyalkyl methacrylates, polycyclic polymers, polyurethanes, polyalkylene oxides and polyesters, lubricity agents, water and the like.

It is also contemplated that the base stocks as aforementioned can be utilized singly or as a fluid composition containing two or more base stocks in varying proportions. The base stocks can also contain other fluids which include, in addition to the functional fluids, desired fluids derived from coal products, synthetics, and synthetic oils, e.g., alkylene polymers (such as polymers of propylene, butylene, etc., and mixtures thereof), alkylene oxide type polymers (e.g., propylene oxide polymers), and derivatives, including alkylene oxide polymers prepared by polymerizing the alkylene oxide in the presence of water or alcohol, e.g., ethyl alcohol, alkyl benzenes, (e.g., monoalkyl benzene such as dodecyl benzene, tetradecyl benzene, etc.) and dialkyl benzene (e.g., n-nonyl 2-ethyl hexyl benzene); polyphenols, (e.g., biphenyls and terphenyls), halogenated benzene, halogenated lower alkyl benzene and monohalogenated diphenyl ethers.

However, in the preferred form of the present invention, the low molecular weight polyester of the present invention will be combined with a phosphate functional fluid base stock. The base stock will consist primarily of trialkylphosphates being present in amounts from 50 to 95% by weight and preferably from 60 to 90% by weight. The trialkylphosphates which give optimum results are those wherein each of the alkyl groups contain from 1 to 20 carbon atoms, preferably from 3 to 12 carbon atoms and more preferably, from 4 to 9 carbon atoms. The alkyl groups are preferably of straight chain configuration. A single trialkyl phosphate may contain the alkyl group in all three positions or may possess a mixture of different alkyl groups. Mixtures of various trialkyl phosphates can be used. Suitable species of trialkyl phosphates which may be employed as the base stock composition include tripropyl phosphates, tributyl phosphates, trihexyl phosphates, trioctyl phosphates, dipropyl octyl phosphates, dibutyl octyl phosphates, dipropyl hexyl phosphate, dihexyl octyl phosphate, dihexyl propyl phosphate, and propyl butyl octyl phosphate.

The trialkyl phosphates can be combined with triaryl phosphates. Preferred triaryl phosphates are cresyl diphenyl phosphate, tricresyl phosphate, trixylenyl phosphate, tertiary butyl phenyl phenyl phosphates, ethyl phenyl dicresyl phosphate or isopropylphenyl diphenyl phosphate, phenyl-bis(4-alpha-methylbenzylphenyl) phosphate. In one preferred embodiment, a base stock containing primarily trixylenyl phosphate is employed. The triaryl phosphates function as a thickener for the trialkyl phosphates. Thus, the amount of triaryl phosphate may range between 0 to 35 by weight. The preferred range of the triaryl phosphates will be from about 10 to about 30 by weight of the composition.

Combinations of antioxidants and/or acid acceptors in amounts ranging from about 0.1 to about 5% by weight may also be incorporated into the functional fluid composition, such as, epoxides and/or amines. The composition 3,4-epoxycyclohexylmethyl 3,4-epoxycyclohexane carboxylate and phenyl -α- naphthylamine has been found to be very effective.

Corrosion inhibitors such as benzotriazole, quinizarin or the like in an amount ranging between 0.001 and 0.5% by weight can be added to the mixture and thoroughly blended therewith. A dye in a concentration range between 5 and 20 parts per million can be added to the composition and blended therewith in a conventional manner. Effective amounts of a silicone antifoaming agent can also be incorporated into the composition and are usually most effective in an amount ranging between 5 and 50 parts per million.

It has been found and practiced that when the low molecular weight polyester of the present invention is blended with the above preferred functional fluid compositions, the properties thereof are superior to available known commercial fluids without said additive.

The invention can be better appreciated by the following nonlimiting example. All parts and percentages are by weight, unless otherwise noted.

EXAMPLE

A base stock consisting of 78.98 weight percent of tributyl phosphate and 9.70 weight percent of mixed cresyl and xylenyl phosphates with a viscosity of approximately 220 Saybolt Universal Seconds at 100°F. is combined with 9.00 weight percent of a low molecular weight propylene glycol polyester of azelaic acid, Plastolein[R] 9789 sold by Emery Industries. Thereafter, 1.0 weight percent of 3,4-epoxycyclohexylmethyl 3,4-epoxycyclohexane carboxylate and 1.0 weight percent of phenyl alpha-naphthylamine are blended into this mixture. Then 0.02 weight percent of benzotriazole corrosion inhibitor is thoroughly blended therewith along with conventional dye and antifoam agents in the amount of 20 parts per million, and 15 parts per million, respectively. Thereafter, 0.3 weight percent of dodecyl trimethyl ammonium diphenyl phosphate is blended into the mixture.

The composition prepared as above was treated in a system pressurized by an actual aircraft type pump. Therefore, data obtained for the viscosity change of the fluid due to mechanical shear in this apparatus is directly applicable to that which would be observed in service. The following viscosity data was obtained for two qualified aircraft hydraulic fluids and for the fluid described above.

| | Viscosity in Centistokes at 100°F. | | |
|---|---|---|---|
| Test Time (Hrs.) | Qualified Fluid A | Qualified Fluid B | Phosphate Ester Fluid Described Above |
| 0 | 9.5 | 11.9 | 9.5 |
| 50 | 9.0 | 10.0 | 9.5 |
| 100 | 8.9 | 9.3 | 9.5 |
| 200 | 8.8 | 8.9 | 9.5 |
| 300 | 8.7 | 8.7 | 9.5 |

This data has been plotted in the FIGURE and illustrates the shear stability imparted to the fluid by the use of the above polyester.

What is claimed is:

1. A functional fluid composition comprising a mixture of:

1. A base stock material selected from the group consisting of esters of an acid of phosphorus, amides of an acid of phosphorus, mineral oil, synthetic hydrocarbon oil, hydrocarbyl silicates, silicones, aromatic ethers, thioether compounds, chlorinated biphenyls, monoesters, esters of dicarboxylic acids and monohydric alcohols, esters of monocarboxylic acids and polyhydric alcohols, and mixtures thereof; and
2. A low molecular weight polyester of a $C_2$–$C_{18}$ dicarboxylic acid and a $C_2$–$C_{18}$ diol wherein said polyester is present in an amount ranging from about 3 to about 15% by weight and has a molecular weight varying from about 2,000 to about 5,000.

2. A functional fluid composition in accordance with claim 1, wherein said base stock material is selected from the group consisting of esters and amides of an acid of phosphorus, mineral oils, synthetic hydrocarbon oils and mixtures thereof.

3. A functional fluid in accordance with claim 2, wherein said ester of an acid of phosphorus is selected from the group consisting of trialkyl phosphates, triaryl phosphates and mixtures thereof.

4. A functional fluid in accordance with claim 3, wherein said ester of an acid of phosphorus consists of a mixture of trialkyl phosphates and triaryl phosphates.

5. A functional fluid in accordance with claim 4, wherein said trialkyl phosphates are present in an amount ranging between 50 and 95% by weight and said triaryl phosphates are present in an amount up to 50% by weight.

6. A functional fluid in accordance with claim 2 together with a dye and antifoaming agent mixed therewith.

7. A functional fluid in accordance with claim 2 together with a corrosion inhibitor.

8. A functional fluid composition in accordance with claim 10, wherein said corrosion inhibitor is benzotriazole.

9. A functional fluid in accordance with claim 2, wherein said low molecular weight polyester comprises a propylene glycol polyester of azelaic acid.

10. An aircraft hydraulic fluid comprising a base stock material selected from the group consisting of esters of an acid of phosphorus, amides of an acid of phosphorus, mineral oils, synthetic hydrocarbon oils and mixtures thereof, and from about 3 to about 15 percent by weight of a low molecular weight polyester of a $C_2$–$C_{18}$ dicarboxylic acid and a $C_2$–$C_{18}$ diol, wherein said polyester has a molecular weight varying from about 2,000 to about 5,000.

11. The composition of claim 10, wherein said low molecular weight polyester comprises a propylene glycol polyester of azelaic acid.

12. The composition of claim 10, in which said base stock comprises an ester of an acid of phosphorus, 13. The composition of claim 12, in which said esters of an acid of phosphorus are trialkyl phosphates.

14. The composition of claim 12, wherein said ester of an acid of phosphorus is a mixture of trialkyl phosphates and triaryl phosphates or alkyl aryl phosphates.

15. The composition of claim 14, in which said trialkyl phosphates are present in an amount ranging between about 50 and about 95% by weight and the triaryl phosphates or alkyl-aryl phosphates are present in an amount up to 50% by weight.

16. The composition of claim 15, wherein said ester of an acid of phosphorus comprises a mixture of a trialkyl phosphate and an ester selected from the group consisting of alkyl diaryl phosphate and dialkyl aryl phosphates.

17. A method for controlling shear stability in an aircraft hydraulic fluid comprising a base stock selected from the group consisting of esters of an acid of phosphorus, amides of an acid of phosphorus, mineral oils, synthetic hydrocarbon oils and mixtures thereof which comprises incorporating in said hydraulic fluid from between about 1 to about 20 percent by weight of a low molecular weight polyester of a $C_2$–$C_{18}$ dicarboxylic acid and a $C_2$–$C_{18}$ diol.

18. The method of claim 17, wherein said low molecular weight polyester is present in an amount of from about 3 to about 15 weight percent.

19. The method of claim 17 wherein said low molecular weight polyester is present in an amount of from about 5 to about 10 weight percent.

20. The method of claim 17 wherein said low molecular weight polyester comprises a propylene glycol polyester of azelaic acid.

* * * * *

UNITED STATES PATENT AND TRADEMARK OFFICE

CERTIFICATE OF CORRECTION

PATENT NO. : 3,956,154

DATED : May 11, 1976

INVENTOR(S) : Theodore A. Marolewski et al

It is certified that error appears in the above-identified patent and that said Letters Patent are hereby corrected as shown below:

Column 1, line 24, "fluid" should read --flame-- ;
Column 7, diagram, "$R_{23}$" is outside the brackets should be inside brackets;
Column 7, line 68, "each" should read --such-- ;
Column 10, line 28, "treated" should read --tested-- .

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*